US006021907A

United States Patent [19]

O'Brien

[11] Patent Number: 6,021,907

[45] Date of Patent: Feb. 8, 2000

[54] CLOTHING STORAGE RACK SYSTEM

[76] Inventor: Brian Boru O'Brien, 353 Mountain Rd., Wilton, Conn. 06897

[21] Appl. No.: 09/119,241

[22] Filed: Jul. 20, 1998

Related U.S. Application Data

[60] Provisional application No. 60/053,491, Jul. 23, 1997.

[51] Int. Cl.[7] ..... A47F 5/08

[52] U.S. Cl. ..... 211/89.01

[58] Field of Search ..... 211/89.01, 94.01, 211/124; 24/329, 334, 331, 335, 338; 248/316.7

[56] References Cited

U.S. PATENT DOCUMENTS 1,893,570 1/1933 Waite ..... 211/89.01

4,953,714 9/1990 Paul ..... 211/89.01

*Primary Examiner*—Alvin Chin-Shue
*Assistant Examiner*—Sarah Purol
*Attorney, Agent, or Firm*—St. Onge Steward Johnston & Reens LLC

[57] ABSTRACT

A storage rack is described for hanging clothing articles such as ties, belts, scarves and the like from spring loaded clips slidably mounted to rods suspended in front of a backing plate. A support frame in turn spaces the back plate from a mounting surface so that one can more easily grip the arms of the clips to open them for the insertion or removal of a clothing article. In one embodiment a single rack is shown, and in another embodiment a multiple tiered rack is shown wherein one or several racks are pivotally mounted to expose articles on a rack that is behind the moveable rack.

9 Claims, 5 Drawing Sheets

CLOTHING STORAGE RACK SYSTEM

PRIOR APPLICATION

This application is a continuation of my Provisional Patent Application Ser. No. 60/053,491 filed Jul. 23, 1997 and entitled "The Perfect Pinch Tie Rack System". All the contents of that prior application are incorporated herein by reference thereto.

FIELD OF THE INVENTION

This application relates to clothing storage and retrieval racks generally for the storage of men's ties, belts, handkerchiefs, women's scarves and the like and more specifically to such racks suitable for mounting to the inside of a closet door, or the inside wall of a closet or other suitable part of a room. This application further relates to a storage rack for the display of items sold in retail stores and in other industries where any large number of items need to be held securely and organized in a small space.

BACKGROUND OF THE INVENTION

Over the years, many different racks for different garments have been described. For example, in U.S. Pat. No. 3,343,683 a sock rack is shown wherein a number of cloth pins are mounted on a bar. The handles of the pins are pierced by a rod so that the normally closed parts can be opened along a direction that is parallel to the connecting rod to grip a sock between them. In U.S. Pat. No. 1,759,202 a collar and tie storage cabinet are described wherein a pair of hinged arms are vertically and outwardly displaced from each other to each store neckties in vertically displaced locations.

In U. S. Pat. No. 4,327,837 a rod is used to support Velcro type fasteners with which belts are supported. Ties are held by loops that are affixed with Velcro fasteners to a tie rack. U.S. Pat. No. 1,937,646 teaches a clothes drier in which a plurality of clothespins are mounted side by side on cross pieces. A garment hanger with spring loaded clamps to hold the articles is shown in U. S. Pat. No. 2,640,598.

Though these prior garment hanging devices can be useful for ties, problems tend to arise when these prior art techniques need to be effective in the organizing, storing, and retrieving of ties in the small spaces often provided in small closets and/or on the moveable surfaces of an open closet door. Many ties need to be stored and often a fixed arrangement of the clips used to hold the ties makes it difficult to accommodate the number of ties that need to be stored. The fixed arrangement of the clips also makes it difficult to see and to organize the ties and to open the clips, particularly when the device is anchored on a moveable door. The nature of a tie itself with its slippery silk fabric and long shape further adds to these difficulties.

A need, therefore, exists to provide a rack system in which the articles are conveniently hung and mounted in a dense and yet visible manner while at the same time providing for a method to ease the insertion and removal of the articles from the rack regardless of whether or not the rack is hung on a door or wall and without knocking other articles off the rack in the process.

SUMMARY OF THE INVENTION

In one illustrative example of the invention a garment mounting system in accordance with the invention, a plurality of miniature clips, formed of vinyl coated metal and having a coiled spring with a through bore, are mounted on a rod so that the opening arms of the pins pivot transversely to the direction of the rod. A support frame is provided for the rod and has a wood, metal or plastic backing plate is placed behind the rod. End located spacers space the backing plate from a mounting surface so that one can grip a clip between a thumb and one or more fingers placed behind the backing plate to easily open the clip and insert or remove a garment such as a tie.

With a garment mounting system one can place ties close to each other and still be able to easily see and remove one. One can slide the clips to which the ties are held out of the way without dislodging anyone of the ties. As a result more ties can be seen and stored than with a fixed clip arrangement while viewing the ties head on.

In another embodiment a multiple tier structure is provided wherein several support frames are mounted on a support structure in a way so that rows of tie clips are placed on rods that are spaced one above the other and laterally so as to provide adequate room for the ties. In this arrangement the ties are also viewable head on and can be conveniently affixed with spring loaded clips. Backing plates are also placed behind each of the rods to allow for easy opening/closing of the clips.

In still another embodiment in accordance with the invention, multiple tiers of tie rods with backing plates behind them are pivotally mounted on a support structure so as to facilitate the insertion and removal of ties. Individual tiers can be pivotally mounted to facilitate access to ties on rods located behind forward positioned tiers.

It is, therefore, an object of the invention to provide a rack for hanging clothing articles such as ties, belts and the like in a convenient manner that enhances the organization and visibility of the articles stored as well as the ability to more quickly insert and remove the desired article from the rack.

This and other advantages and objects of the invention will become apparent from the following detailed description of several embodiments as shown in the drawings.

DETAILED DESCRIPTION OF DRAWINGS

Figures 1, 2, 3:
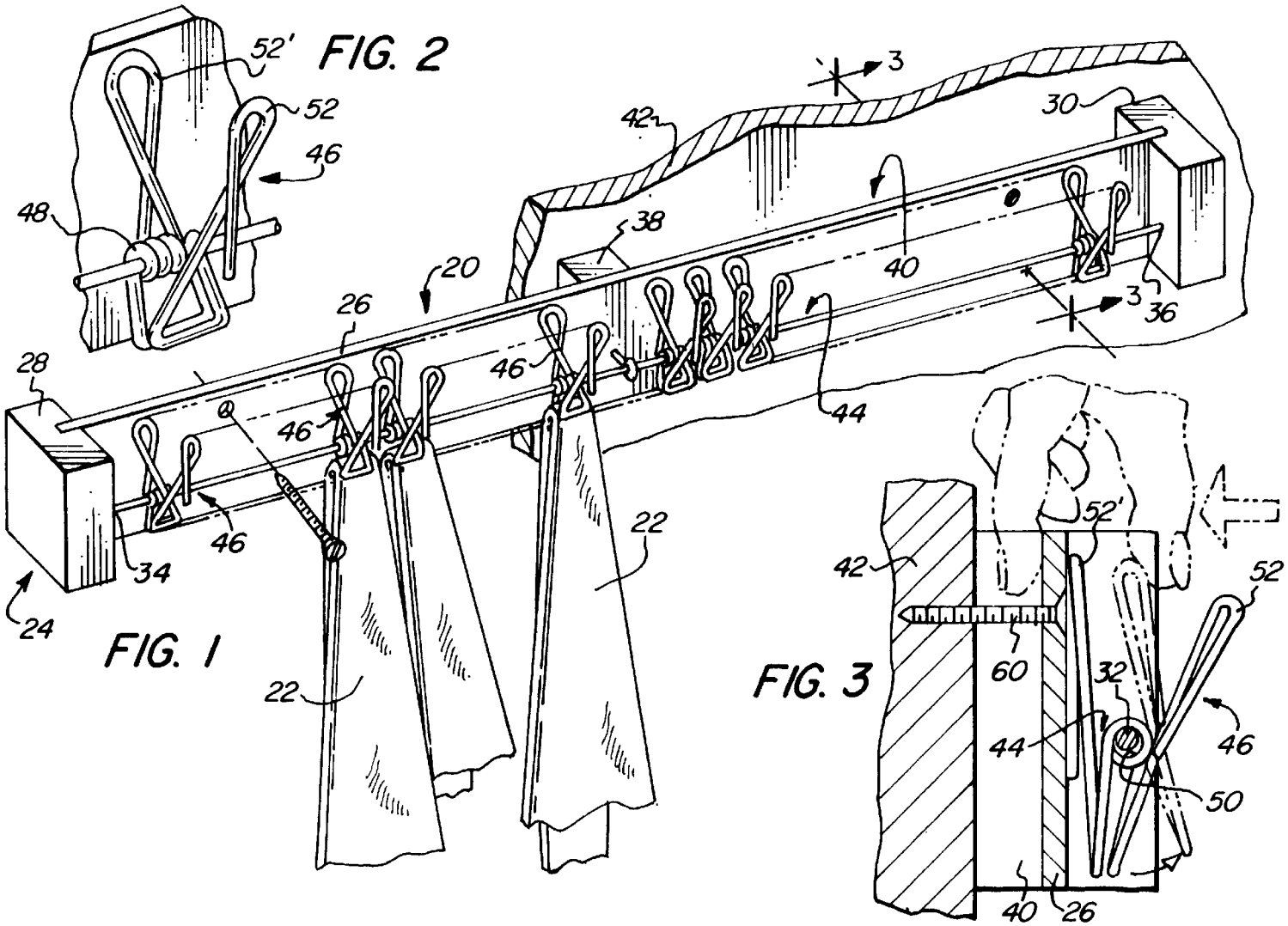
FIG. 1 is a perspective view of one rack in accordance with the invention for storing clothing articles.
FIG. 2 is an enlarged perspective view of a retaining clip used to hold ties or other clothing articles in a rack in accordance with the invention.
FIG. 3 is a section view of the storage rack of FIG. 1 taken along the line 3—3 therein.
Figure 4:
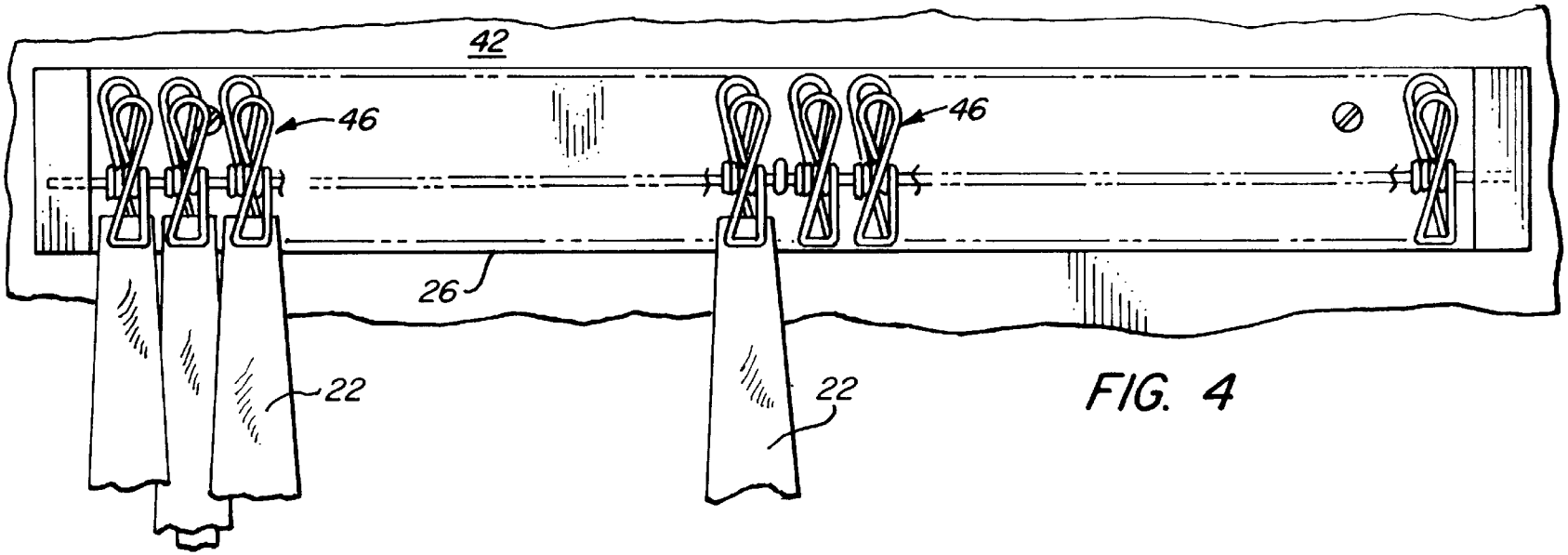
FIG. 4 is a front view in elevation view of the storage rack shown in FIG. 1.
Figure 5:
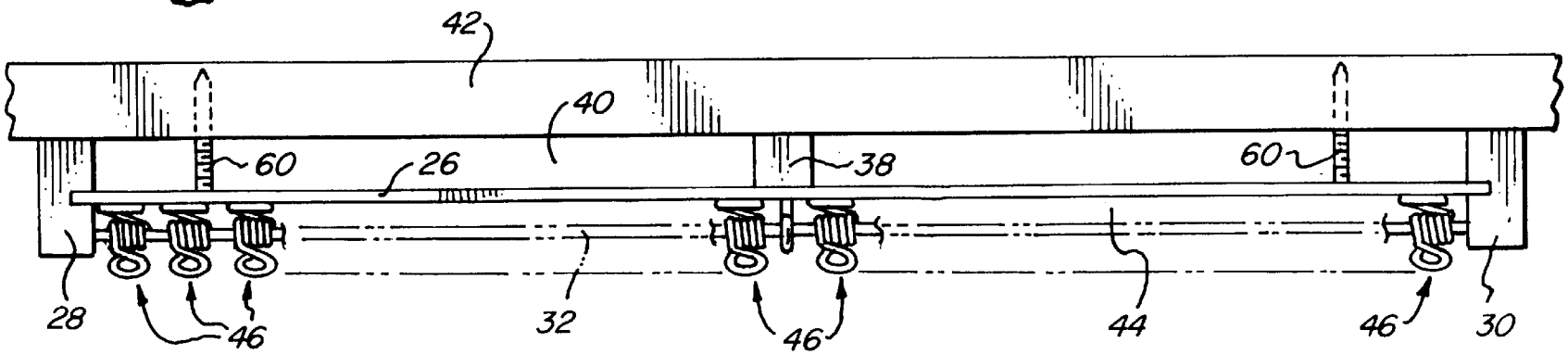
FIG. 5 is a top view of the storage rack shown in FIG. 1.

With reference to FIGS. 1–5 a storage rack 20 for articles of clothing such as ties 22, or belts, not shown, or the like is shown. The storage rack depicted in these Figures constitutes a single tier and includes a support frame 24 having a back plate 26 and lateral side end located mountings 28, 30. The back plate 26 is provided with a rod 32 the lateral ends 34, 36 of which are supported by mountings 28, 30. An intermediate mounting 38 is located behind the back plate 26. The mountings 28, 30 and 38 serve also to space the back plate 26 with a gap 40 from a mounting surface 42, which could be a wall, or the back of a door or the like.

The rod 32 is spaced from backing plate 26 to form a gap 44 so as to enable spring loaded clips 46 to be mounted on and slide along rod 32. The spring loaded clips 46 can be of a conventional type having a coiled spring 48 with a through bore 50. The through bore preferably is larger in diameter than that of the rod 32 so that the clips 46 can slide along the rod if room is available. It should be understood, however, that a tight non-sliding fit is also contemplated by the invention.

The clip's finger engaging arms 52, 52' are connected to coiled spring 48 which urges them apart, while the clip ends 54, 54' are urged towards each other to enable them to grip clothing articles such as ties 22. The placement of the rod 32 through the bore 50 of coiled spring 48 orients the clips 46 so that one can conveniently open the clip ends 54, 54' by either simply pushing against finger engaging arm 52 while the other arm 52' is seated against the back plate 26, or by gripping the clip arm 52 and back plate 26 as shown in FIG. 3 between the thumb and forefinger with the forefinger in the gap 40.

Attachment of the storage rack 20 to mounting surface 40 can be done by screws such 60 applied through mounting holes 62. The storage rack 20 is preferably made of wood, though other materials such plastic, metal and particle board could be used. The clips 46 are preferably vinyl covered metal clips.

Figure 6:
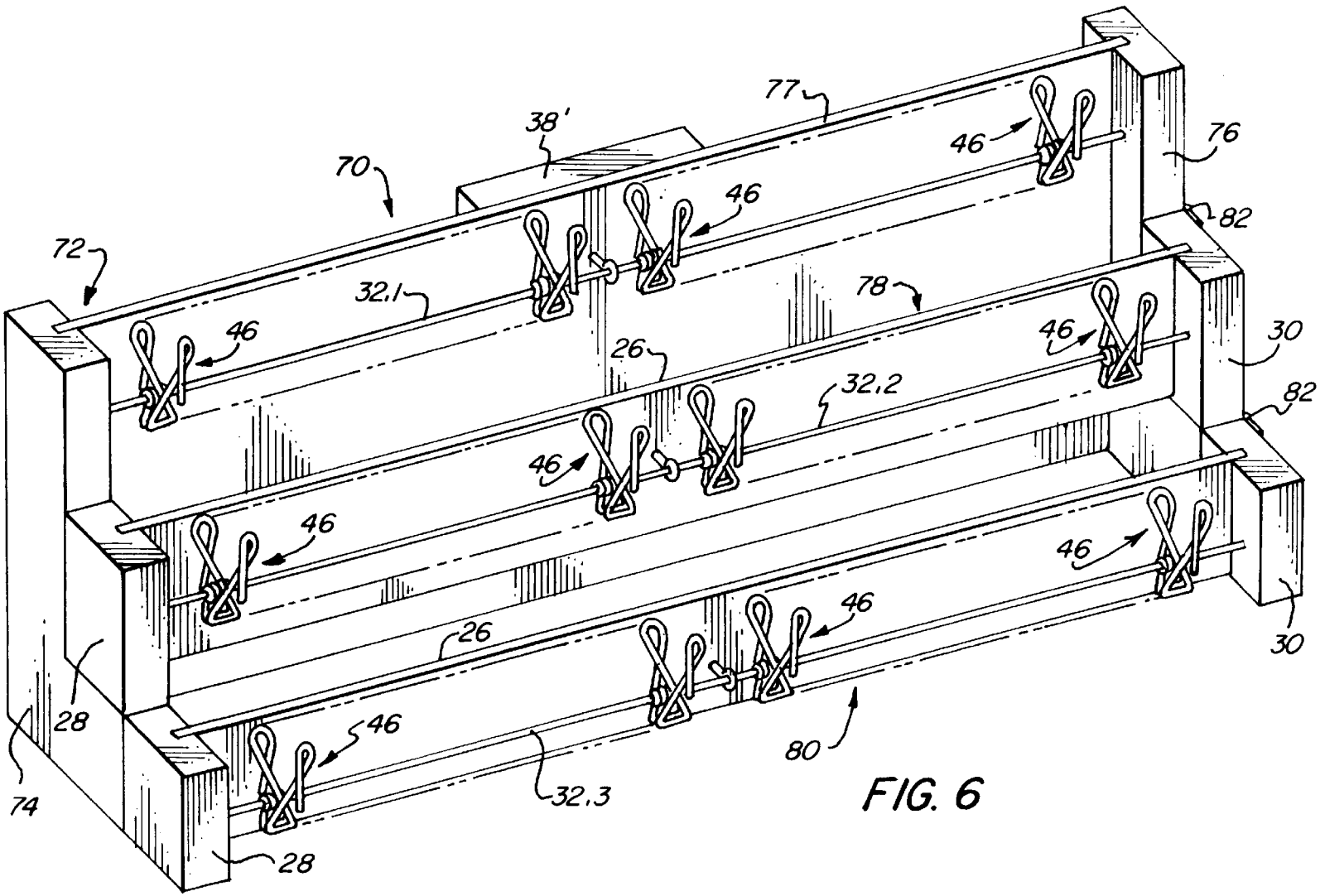
FIG. 6 is a perspective view of a multiple tiered outwardly pivotal version of a clothing storage rack in accordance with the invention.
Figures 7, 8:
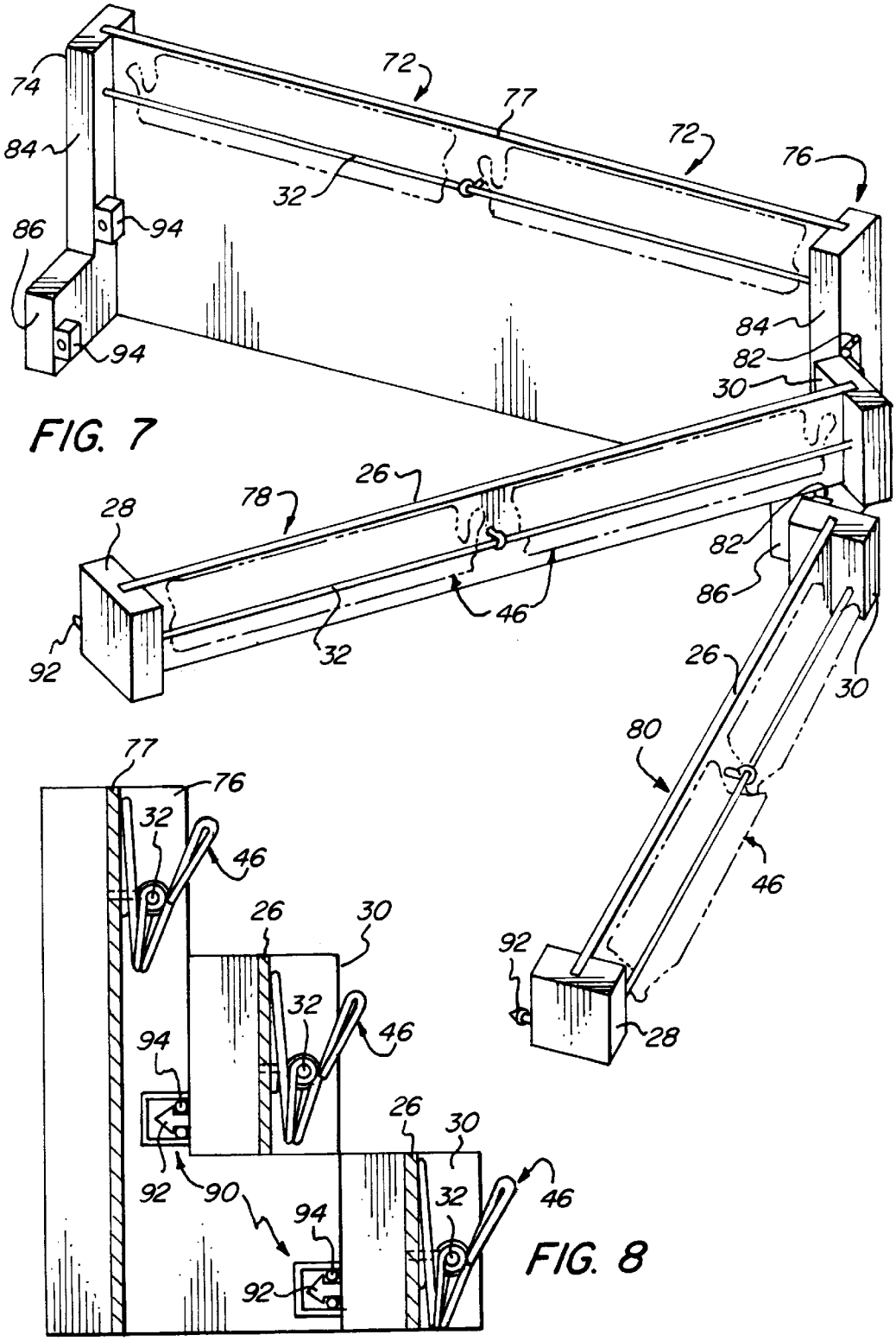
FIG. 7 is a perspective view of the multiple tiered clothing storage rack of FIG. 6 with the pivotally mounted tiers opened up.
FIG. 8 is a side sectional view of the storage rack of FIG. 7.

With reference to FIGS. 6–8 another embodiment of a clothing article storage rack 70 in accordance with the invention is shown using spring loaded clips 46 mounted on rods 32.1, 32.2 and 32.3 on a support frame 72. The support frame 72 is made with mountings 74, 76 affixed to a larger back plate 77. Pivoting storage rack assemblies 78, 80 are connected to mountings 74,76 with hinges 82 to enable the rack assemblies 78, 80 to be pivoted outwardly as shown in FIG. 7.

The storage rack assemblies 78, 80 are similar to the storage rack 20 shown in FIG. 1, thus using end located mountings 28, 30 affixed to a back plate 26 and rods 32 mounted in front of the back plates 26. Mountings 74 and 76 have seating surfaces 84, 86 to receive, in a removable fashion, the mountings 28, 30. Thus storage rack assembly 78 has its mounting 28 seat against surface 84 while resting on surface 88 and storage rack assembly 80 has its mounting 28 seated against surface 86.

Locking fasteners 90 are used to retain mountings attached to the support frame 72. These fasteners can take many forms with a simple push-on and pull-off type preferred. This includes a male element 92 attached to the movable mountings 28 and a fixed female element 94 on the support frame 72. The male and female elements can be reversed and other releasable fasteners used.

Figure 10:
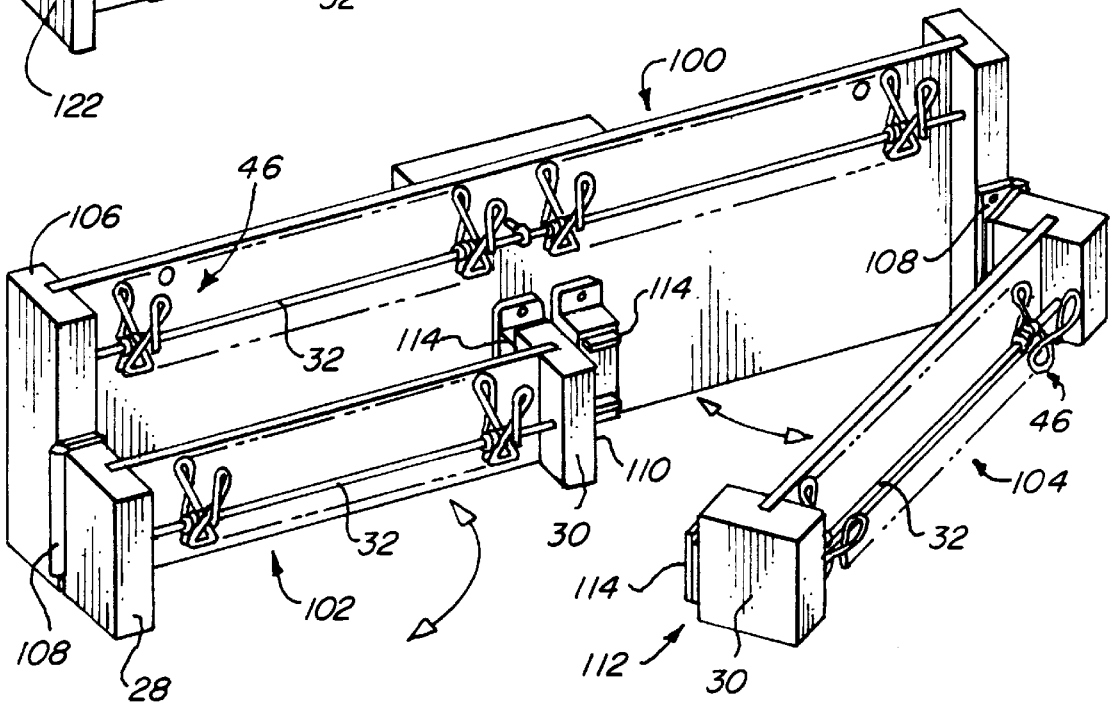
FIG. 10 is a perspective view of still another embodiment of a multiple tiered tie rack in accordance with the invention.

With reference to FIG. 10 another embodiment for a tie storage rack 100 is shown wherein movable storage rack assemblies 102 and 104 are respectively pivotally mounted to a support frame 106 with hinges 108. The rack assemblies 102, 104 are at the same vertical level and their free ends 110, 112 meet generally at a point that is between the ends of the support frame 106 and preferably about its mid point. Fasteners in the form of magnetic elements 114 are used to hold mountings 30 removably in place.

Figure 9:
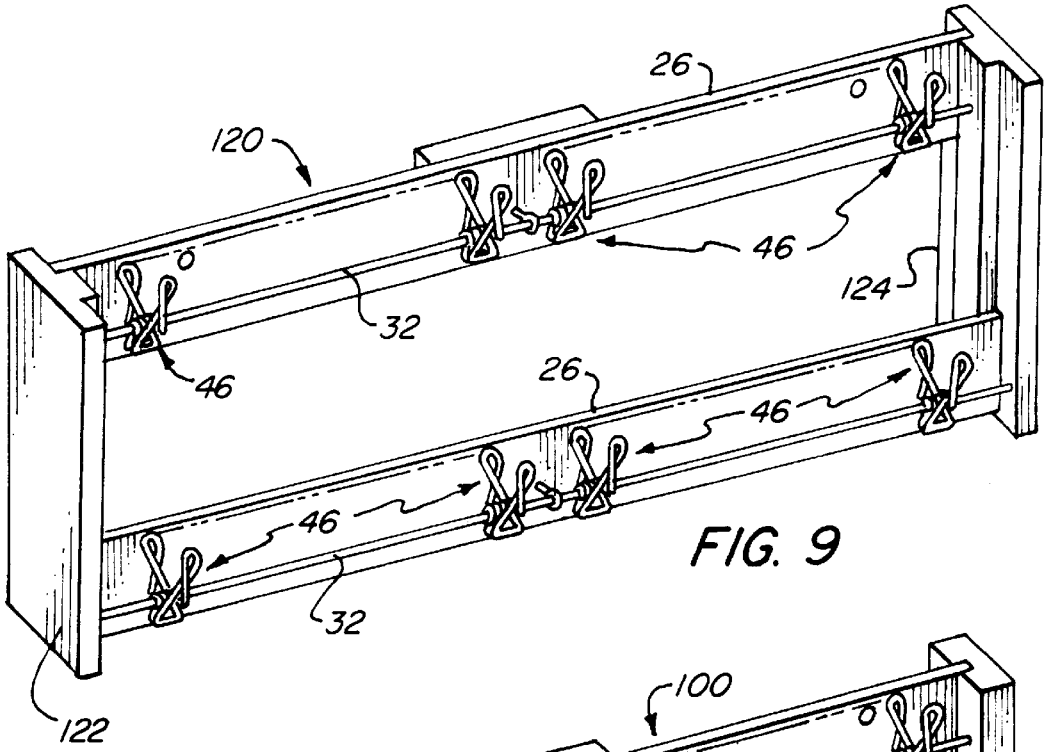
FIG. 9 is a perspective view of another multiple tiered clothing storage rack in accordance with the invention.

FIG. 9 illustrates another tie storage rack 120 wherein a pair of back plates 26 are respectively affixed to mountings 122 and 124 with the vertical spacing of the back plates 26 increased to enhance visibility of ties held by spring loaded clips 46.

Having thus described several embodiments in accordance with the invention its advantages can be appreciated. Variations from the embodiments can be made by one skilled in the art without departing from the invention as defined by the following claims.

What is claimed is:

1. A rack for hanging clothing articles such as ties, belts and the like with the rack affixed to a mounting surface such as a wall or the back of a closet door, comprising:

a support frame having a back plate and mountings placed to space the back plate from the mounting surface and form a sufficiently wide gap to place a finger therein;

a rod located along the back plate and spaced therefrom;

a plurality of spring loaded clips having a coiled spring with a through bore, said clips each having first and second arms connected to said coiled spring; said arms having juxtaposed finger engaging ends, said finger engaging ends being normally urged apart so as to urge the clip ends towards each other while being movable towards each other to pivot juxtaposed clip ends away to receive a clothing article between them for retention thereby;

said rod freely extending through said through bores of the clips to enable them to slide along the rod and with the pivot action of the clip ends being substantially coaxial with said rod; with said rod and clips being so mounted to said support frame that one of said finger engaging ends can be seated against the back plate and said clip ends can be spread apart by urging the other finger engaging end towards the back plate when a person's fingers grip the latter finger engaging end and the back plate.

2. The rack as claimed in claim 1 wherein said mountings are located at ends of the back plate and wherein said rod has ends supported by the mountings.

3. The rack as claimed in claim 1 wherein said support frame and said mountings are made of a material selected from the group consisting of wood, metal, plastic and particle board.

4. The rack as claimed in claim 1 wherein said support frame has a plurality of back plates with said rods and said spring loaded clips and arranged in tiered fashion with one above the other for a vertical distance sufficient to view, from a frontal viewing point, articles of clothing held by clips and respectively forwardly spaced from each other so as to form gaps between the back plates sufficiently wide to receive said articles of clothing.

5. The rack as claimed in claim 1 wherein at least one of said racks has one lateral side pivotally mounted to said support frame so as to pivot outwardly towards the front of the rack and expose articles of clothing held by clips on a back plate behind the pivotally mounted rack.

6. The rack as claimed in claim 1 wherein said pivotally mounted back plate has a releasable fastening element at an opposite lateral side from said one lateral side to hold the latter back plate to said support frame.

7. The rack as claimed in claim 4 wherein said support frame has an upper located back plate affixed at lateral ends and a second back plate located lower than and forwardly of said upper back plate; said second back plate having one lateral side end pivotally affixed to said support frame and another opposite lateral side end releasably attachable to said upper back plate at a location that is between lateral side ends of said upper back plate; said second back plate having a said rod and said clips mounted thereon.

8. The rack as claimed in claim 7 and a third back plate located lower than and forwardly of said upper located back plate at a vertical level that is generally the same as said second back plate; said third back plate having a said rod and said clips mounted thereon; said third back plate further having one lateral side end pivotally affixed to said support frame and another opposite lateral side end releasably attachable to said upper back plate at a location that is between lateral side ends of said upper back plate.

9. The rack as claimed in claim 8 and further including magnetic fastener elements mounted to said back plates to releasably hold lateral side ends of the second and third back plates to said upper back plate.

* * * * *